United States Patent [19]

Oda et al.

[11] 4,300,221

[45] Nov. 10, 1981

[54] ELECTRONIC TIMEPIECE

[75] Inventors: Hajime Oda; Nakanobu Moritani; Toshihide Samejima, all of Tokyo, Japan

[73] Assignee: Kabushiki Kaisha Seikosha, Tokyo, Japan

[21] Appl. No.: 922,434

[22] Filed: Jul. 6, 1978

[51] Int. Cl.[3] ..... G04B 19/22

[52] U.S. Cl. ..... 368/22; 368/71; 368/72; 368/239; 368/250

[58] Field of Search ..... 58/24, 42.5, 50 R, 19 R, 58/21.11, 85.5, 23 R, 58, 39.5; 235/92 T; 368/21, 22, 82, 83, 84, 71, 72, 73, 239, 240, 241, 242, 250, 251

[56] References Cited

U.S. PATENT DOCUMENTS

| | | | |
|---|---|---|---|
| 3,662,535 | 5/1972 | Hedrick et al. | 58/39.5 |
| 3,810,356 | 5/1974 | Fujita | 58/23 R |
| 3,852,950 | 12/1974 | Yoda et al. | 58/58 X |
| 3,945,191 | 3/1976 | Van Berkum | 58/50 R X |
| 3,961,473 | 6/1976 | Hung | 58/39.5 X |
| 3,980,868 | 9/1976 | Thompson | 235/92 T |
| 4,045,951 | 9/1977 | Tanaka | 58/152 R |
| 4,062,180 | 12/1977 | Meshi et al. | 58/50 R X |
| 4,072,005 | 2/1978 | Teshima | 58/42.5 |
| 4,110,969 | 9/1978 | Fukuichi | 58/85.5 |

*Primary Examiner*—Ulysses Weldon

*Attorney, Agent, or Firm*—Robert E. Burns; Emmanuel J. Lobato; Bruce L. Adams

[57] ABSTRACT

An electronic timepiece suitable for use as a worldtime clock having a main display section adapted to perform a display of the particular time selected from among a plurality of kinds of time and a sub-display section adapted to perform a display of another time selected from among the other kinds of time than that displayed in the main display section. Means are provided for selective setting and correction all of the times.

6 Claims, 2 Drawing Figures

ELECTRONIC TIMEPIECE

BACKGROUND OF THE INVENTION

In conventional electronic timepiece of a type having such functions to display a plurality of kinds of time, there is provided only one display section to display any one time corresponding to the function selected. In addition, the conventional electronic timepiece has suffered from a disadvantage in that another function performed by the timepiece cannot be used when a time corresponding to one of the time functions is on display, due to the common use of a counter for counting times of the various functions. In an electronic timepiece having an alarm and world time displaying functions, it is a serious inconvenience because the use of the alarm function is incompatible with the locat time display which is essential in overseas trips. In addition, the electronic timepiece is rendered inconvenient by the fact that the alarm time can be set in relation with the standard time only, i.e. the alarm time cannot be set relative to the local time.

SUMMARY OF THE INVENTION

The present invention relates to an electronic timepiece and, more particularly, to an electronic timepiece having a main and a sub display sections adapted to selectively display different times.

It is therefore an object of the invention to provide an electronic timepiece having a main and a sub display sections adapted to perform selective display of various times so as to enable the user to recognize and understand which different times in comparison with one another.

It is another object of the invention to provide an electronic timepiece in which the time displayed on the main and the sub-display sections can be adjusted selectively, so that the user may adjust one of two times of a known time differential, e.g. the standard time and a local time, while watching the other time.

It is still another object of the invention to provide an electronic timepiece in which the setting of the alarm time can be made relative the standard time or local time of a known time differential from the standard time.

DESCRIPTION OF THE PREFERRED EMBODIMENTS

Figure 1:
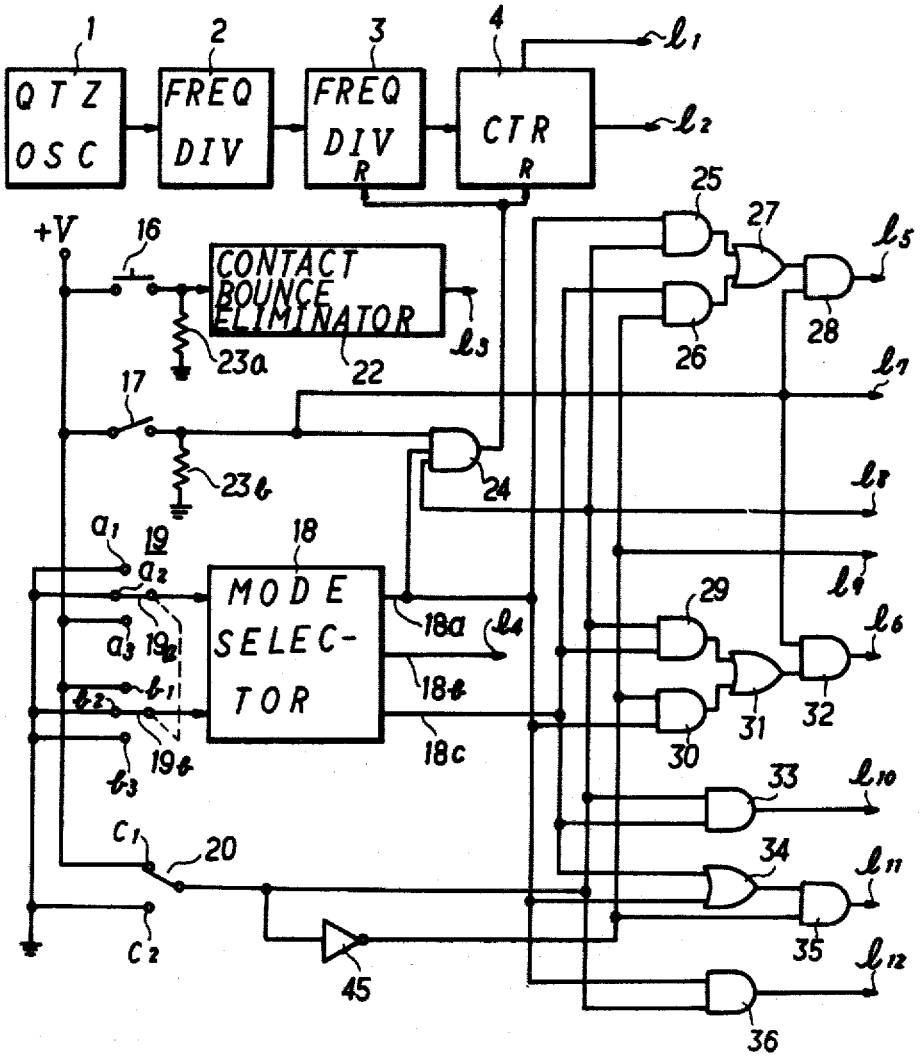
FIGS. 1 and 2 are an electric system diagram of an embodiment of the invention.
Figure 2:
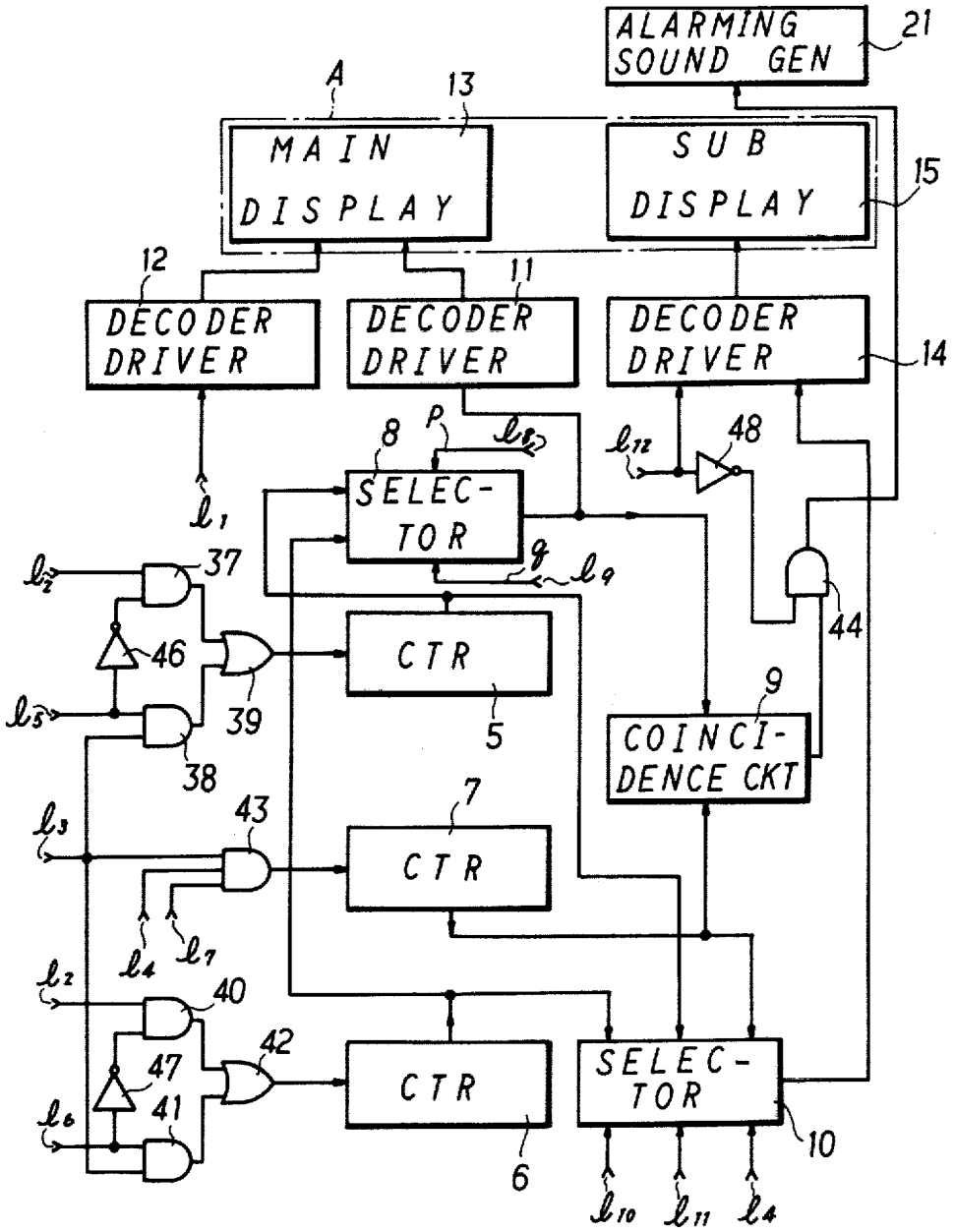

The output frequency from a quartz oscillator 1 is divided to 1 Hz by means of frequency dividers 2,3, Counters 4 and 5 are adapted to count second and hour/minute time units of the standard time, while a counter 6 is adapted to count hour and minute time units of a local time. A preset counter 7 is provided for the setting of an alarm time. A selector 8 is adapted to select between the outputs from the counters 5,6 in accordance with signal p or q applied thereto. A coincidence circuit 9 is adapted to provide a coincidence signal when the outputs from the counter 7 and the selector 8 come to coincide with each other. A selector 10 comprises gate circuits and is provided for selecting between the outputs from the counter 5 to 7. Decoder drivers 11 and 12 are adapted to convert the outputs from the selector 8 and the counter 4 into signals suitable for display on a main display section 13 of a display means A, while another decoder driver 14 is intended for converting the output from the selector 10 into a signal suitable for display on a sub display section 15 of the display means A. A switch 16 is adapted to generate correcting pulses for changing the contents of the counters 5 to 7. A switch 17 is adapted to be closed only when the pulse developed in response to operation of the switch 16 is required, and is kept normally opened. The arrangement is such that the contents of the counters 5 to 7 are never changed, even if the switch 16 is erroneously operated.

A mode selector 18 comprises gate circuits and is adapted to select the modes of a time of a standard location (referred to simply as standard time), an alarm and a local time, and to produce corresponding outputs at its terminals 18*a*,18*b* and 18*c*. Those modes are selected by a mode selecting switch 19. The mode selecting switch 19 consists of two interlocked switches 19*a* and 19*b* adapted to select two contacts from the contacts $a_1$ to $a_3$ and $b_1$ to $b_3$. More specifically, the designation of the standard time mode is obtained when the switches 19*a* and 19b are connected to the terminals $a_1$ and $b_1$, while the alarm mode is obtained when the same switches are connected to the terminals $a_2$ and $b_2$, respectively. Similarly, the designation of the local time mode is obtained by connecting the switches 19*a* and 19*b* to the terminals $a_3$ and $b_3$.

Thus, two logic values are set by selecting two terminals, so as to selectively produce mode designation outputs. A switch 20 is provided for effecting the display of the selected one of the standard time and the local time on the main display section 13. Namely, the standard time is displayed on the main display section 13 when the switch 20 is connected to the terminal $c_1$, whereas the local time is displayed on the same display section when the switch 20 is connected to the terminal $c_2$.

An alarm sound generator 21 is adapted to produce an alarm sound upon receipt of the coincidence output signal from the coincidence circuit 9.

A contact bounce eliminatior 22 is provided for eliminating the contact bounce produced when the switch 16 is operated. Reference numerals 23*a* and 23*b* denote resistances, 24 to 44 inclusive denote gate circuits and 45 to 48 denote inverters.

Hereinafter, the operation of the electronic timepiece will be described. In the following description of the operation, the continuous display of the standard time on the main display section 13 will be referred to as zone I, while the display of the local time on the same section will be referred to as zone II.

Referring first to the zone I, the switch 20 is connected to the terminal $c_1$ for selecting the zone I. Consequently, gate circuits 25,29,33 and 36 are opened and one of the inputs to the gate circuit 24 is held at a logic value "1". Meanwhile, the signal level of input P to the selector 8 is turned to a value "1", so as to select the output from the counter 5, thereby to effect the display of hour and minute unit of the standard time. The display of the seconds unit of time is continuously made on the main display section 13 by the output from the counter 4, through the decoder driver 12. In this state, as the standard time mode is selected by the switch 19, i.e. as the switches 19*a*,19*b* are connected to the terminals $a_1$,$b_1$, an output "1" is produced at the terminal 18*a* of the mode selector 18, so that the alarm-off state is displayed on the sub display section 15 by the decoder driver 14, through the gate circuit 36, so as to indicate that there is no alarm time set in the counter 7.

The correction of the standard time is achieved in the following manner. First, the switch 17 is closed and the switches 19*a* and 19*b* are connected to the terminals $a_1$ and $b_1$, respectively. Consequently, the gate circuit 24 produces an output "1", so that the frequency divider 3 and the counter 4 are reset. Simultaneously, the output from the gate circuit 25 is turned to a value "1", so that the gate circuits 27 and 28 produce respective outputs "1". Consequently, the gate circuit 38 is opened, whereas the gate circuit 37 is closed.

Pulses are supplied to the counter 5, through the gate circuits 38 and 39, as the switch 16 as shown in FIG. 1 is opened and closed repeatedly. The output from the counter 5 is supplied to the main display section 13 through the selector 8 and the decoder driver 11.

This operation is continued by the user while he observes the time displayed on the main display section 13, until the designated time is displayed, so as to make the correction of the standard time.

When the alarm mode is designated, the operation of the circuits is as follows. As the switch 19 is switched so as to produce a signal having a logic value "1" at the terminal 18*b* of the mode selector 18, the output from the counter 7 is selected by the selector 10, so that the contents of the alarm counter 7 are displayed on the sub-display section 15 through the decoder driver 14.

Meanwhile, since one of the inputs to the gate circuit 43 is a logic value "1", the gate circuit 43 is opened by closing the switch 17. Thus, pulses are supplied to the counter 7 through the gate circuit 43, by a repeated opening and closing of the switch 16, so as to enable the user to read the alarm time displayed in the sub-display section 15 thereby to set the desired alarm time by opening and closing the switch 16 repeatedly until the desired alarm time is indicated on the display.

As time elapses, the standard time comes to coincide with the alarm time set in the counter 7. At this moment, the coincidence circuit 9 produces an output signal, which is transmitted through the gate circuit 44 to the alarm sound generator 21, so as to make the generator 21 generate an alarm sound.

When the switch 19 is switched for designating the local time mode, the operation of the circuit is as follows.

An output "1" is generated at the terminal 18*c* of the mode selector 18, so that the gate circuit 33 produces an output "1". Consequently, the output from the counter 6 is selected by the selector 10, so that the local time is displayed in the sub-display section 15. Meanwhile, the output available at the terminal 18*c* is delivered, through the gate circuits 29 and 31, to the gate circuit 32, so as to make the latter produce logic an output "1". The gate circuit 41 is opened, while the gate circuit 40 is closed, as the switch 17 is closed. Thus, the desired local time can be set in the counter 6 by opening and closing the switch 16 repeatedly. Then, as the switch 17 is opened, the gate circuit 40 is opened to allow the minute signal to be delivered to the counter 6, so that the latter may count the local time of the local district or time zone.

Referring now to the operation in case of zone II, the gate circuits 26, 30 and 35 are opened as the switch 20 is connected to the terminal $C_2$. Meanwhile, the input q to the selector 8 recieves to a logic value "1", so that the clock output corresponding to the local time is selected and delivered to the main display section 13 through the decoder driver 11. Consequently, the representation of the hour and minute of the local time are made at the main display section 13. The second unit of time of the standard time is continuously displayed at the position for the second unit of time of the local time.

As the standard time mode is designated, the gate circuits 34 and 35 produce respective outputs of logic level "1", so that the output corresponding to the standard time is selected and displayed in the sub display section 15.

For correcting the local time, the switch 17 is closed to apply a signal level "1" to the gate circuit 32. The gate circuit 41 is opened since the outputs "1" are available at the gate circuits 30 and 31. Therefore, the contents of the counter 6 are corrected by opening and closing the switch 16.

The following operation is performed when the alarm mode is designated. The output corresponding to the alarm is selected by the selector 10, and is displayed at the sub-display section 15. The setting of the alarm time is made by opening and closing the switch 16. In case that the zone II has been selected, the alarming sound generator 21 produces the alarm sound when the preset alarm time is reached by the local time, because the output corresponding to the local time is available at the output side of the selector 8.

Having described the operation of the circuits for setting the alarm time in the zone II, it is to be noted here that the setting of alarm time can be effected simply by switching the zone to the zone II and selecting the alarm mode, when there is so need of changing the alarm time set at the standard time district, as is often experienced in case of a trip from a standard time district to a local district. Thus, it is not necessary to recorrect the alarm time after the arrival at the local district.

Turning now to the local time mode, the output corresponding to the standard time is selected by the selector 10 and is displayed in the sub-display section 15. The contents of the counter 5 are corrected by opening and closing the switch 16 repeatedly, after closing the switch 17.

In the described embodiment, the arrangement is made for an independent correction of the contents of the counters 5 and 6 independently from each other. However, it is possible to modify this embodiment to allow a simultaneous correction of the contents of these counters. To this end, in the state of the zone I for example, the output of the standard time mode and the output of the zone I are applied to an AND gate circuit, whose output is connected to the gate circuit 31, so that the contents of the counter 6 are corrected simultaneously with correction of the standard time. Thus, according to this modification, the troublesome separate correction of the standard time and the local time becomes unnecessary, once the local time is correctly set in relation to the standard time.

As has been described, according to the invention, selected one of a plurality of times is displayed in the main display section, while a selected other time is displayed in the sub-display section. Thus, it becomes possible to display the alarm time, local time or another desired time in the sub-display section, while keeping the standard time on display in the main display section, so that the time displayed in the sub-display section may be recognized in relation with or in comparison with the standard time. Thus, according to the invention, various times can conveniently be observed in relation with one another, In addition, by the provision of a time correcting means, the user is enabled to correct one of the times on display, while observing the other. This arrangement is especially effective in case of correction of one of the mutually related times.

What is claimed is:

1. An alarm electronic timepiece, comprising:

time counting means for developing a count representative of a time of day;

first means receptive of electrical pulses for storing an electrical signal representative of an alarm time of the day;

second means receptive of electrical pulses for storing an electrical signal representative of a particular set time of the day and for generating a count representative of an elapse of time after the particular time of the day;

a pulse generator circuit including a manually operable switch for generating electrical pulses in response to operation of said manually operable switch and for applying the electrical pulses to said first means and said second means to set the alarm time and the particular set time by operation of said manually operable switch;

time mode selecting circuit means for producing an output signal to select among the time of the day, the alarm time and the time represented by the content of said second means;

display means responsive to electrical signals for displaying time, said display means including a main display section for displaying time and a sub-display section for displaying time;

third means responsive to the output signal of said time mode selecting circuit means for selectively applying the content of said time counting means, said first means and said second means to said display means for arbitrarily displaying the time of the day, the alarm time or the time represented by the content of said second means on either said main display section or said sub-display section of said display means; and alarm means for generating an alarm signal when the time of day reaches the alarm time.

2. An electronic timepiece comprising: setting and processing means comprised of electronic circuits for counting different times of the day; first selection means for selecting any one of said times of the day; a main display section for displaying time in accordance with the output from said first selection means; second selection means for selecting a time of the day other than the time selected by said first selection means; and a sub-display section for displaying the time selected by said second selection means in accordance with the output from said second selection means.

3. An electronic timepiece as claimed in claim 2, wherein said setting and processing means includes a counter for counting a standard time, a counter for setting an alarm time and a counter for counting a local time.

4. An electronic timepiece as claimed in claim 2, further including: correcting means for selectively correcting one of the contents of said setting and processing means.

5. In an electronic timepiece: means comprised of electronic circuits for generating a plurality of different electrical count signals each representative of a different time of the day, wherein more than one of the different electrical count signals are continually changing with the passage of time; time correcting means operable for setting selected ones of the different electrical count signals for correcting selected times; display means comprising a main display section and a sub-display section for displaying a time of the day on the main display section and for simultaneously displaying a different time of the day on the sub-display section in response to different ones of the electrical count signals applied thereto; first selecting means for selecting one of the electrical count signals and for applying the first selected electrical count signal to said display means for displaying the time of the day corresponding to the first selected electrical count signal on said main display section; and second selecting means for selecting another of the electrical count signals and for applying the second selected electrical count signal to said display means for displaying another time of the day corresponding to the second selected electrical count signal on said sub-display section.

6. An electronic timepiece, comprising:

time counting means for developing a count representative of a time of day;

first means receptive of electrical pulses for storing an electrical signal determined by the received electrical pulses and representative of a first set time of the day;

second means receptive of electrical pulses for storing an electrical signal determined by the received electrical pulses and representative of a second set time of the day and for developing a count representative of an elapse of time after the second set time of the day;

a pulse generator circuit including a manually operable switch for generating electrical pulses in response to operation of said manually operable switch and for applying the electrical pulses to said first means and said second means to set the first and second set times represented by the respective signals stored in said first means and said second means by operation of said manually operable switch;

time mode selecting circuit means for producing an output signal to select among the time of the day, the first set time and the time represented by the content of said second means;

display means responsive to electrical signals for displaying time, said display means including a main display section for displaying time and a sub-display section for displaying time; and third means responsive to the output signal of said time mode selecting circuit means for selectively applying the content of said time counting means, said first means and said second means for arbitrarily displaying time of day, the first set time or the time represented by the content of said second means on either said main display section or said sub-display section of said display means.

* * * * *